US007641981B2

(12) United States Patent
Sato et al.

(10) Patent No.: US 7,641,981 B2
(45) Date of Patent: Jan. 5, 2010

(54) SURFACE TREATED METAL MATERIAL

(75) Inventors: Hiroyuki Sato, Aichi (JP); Takaomi Nakayama, Kanagawa (JP); Toshiyuki Aishima, Aichi (JP)

(73) Assignee: Nihon Parkerizing Co., Ltd., Tokyo (JP)

( * ) Notice: Subject to any disclaimer, the term of this patent is extended or adjusted under 35 U.S.C. 154(b) by 167 days.

(21) Appl. No.: 11/886,554

(22) PCT Filed: Mar. 15, 2006

(86) PCT No.: PCT/JP2006/305116

§ 371 (c)(1),
(2), (4) Date: Sep. 17, 2007

(87) PCT Pub. No.: WO2006/098359

PCT Pub. Date: Sep. 21, 2006

(65) Prior Publication Data

US 2009/0004491 A1 Jan. 1, 2009

(30) Foreign Application Priority Data

Mar. 16, 2005 (JP) ..... 2005-076057

(51) Int. Cl.
*B32B 15/04* (2006.01)
*B32B 15/00* (2006.01)

(52) U.S. Cl. ..... 428/469; 428/472

(58) Field of Classification Search ..... None
See application file for complete search history.

(56) References Cited

U.S. PATENT DOCUMENTS

| | | | | |
|---|---|---|---|---|
| 5,853,806 | A * | 12/1998 | Higuchi et al. | 427/310 |
| 6,059,896 | A | 5/2000 | Ehara et al. | |
| 6,361,833 | B1 | 3/2002 | Nakada et al. | |

FOREIGN PATENT DOCUMENTS

| | | | |
|---|---|---|---|
| EP | 0 838 537 | | 4/1998 |
| EP | 1489198 | A1 * | 12/2004 |
| JP | 56-136978 | | 10/1981 |
| JP | 07-228961 | | 8/1995 |
| JP | 08-176841 | | 7/1996 |
| JP | 09-025436 | | 1/1997 |
| JP | 09-031404 | | 2/1997 |
| JP | 2000-199077 | | 7/2000 |
| JP | 2000-204485 | | 7/2000 |
| JP | 2004-190121 | * | 7/2004 |
| WO | WO 96/19595 | | 6/1996 |
| WO | WO 02/103080 | | 12/2002 |
| WO | WO 02-103080 | A1 * | 12/2002 |

* cited by examiner

*Primary Examiner*—Jennifer McNeil
*Assistant Examiner*—Vera Katz
(74) *Attorney, Agent, or Firm*—Flynn, Thiel, Boutell & Tanis, P.C.

(57) ABSTRACT

A metal material having a coating formed by a surface treatment on the surface of the metal material is provided. The coating has an excellent corrosion resistance with or without a further coating that is equivalent or superior to the prior art coating formed by zinc phosphate treatment or chromate treatment, is free from sludge formation or environmentally harmful components, and is formed by using a component capable of deposition with a simple method. A surface-treated metal material having on a surface of a metal material a coating layer formed by a surface treatment, the coating layer containing the following components (A) and (B), wherein (A) is an oxide and/or hydroxide of at least one metallic element selected from the group of Ti, Zr, and Hf and (B) is aluminum; wherein, in the coating layer formed by the surface treatment, the weight ratio $K_1$ (=B/A), which is the weight ratio of the coating weight B of aluminum of the component (B) to the total coating weight A of the metallic element in the component (A), is in the range of $0.001 \leqq K_1 \leqq 2$.

5 Claims, No Drawings

SURFACE TREATED METAL MATERIAL

TECHNICAL FIELD

This invention relates to a metal material having a coating formed thereon by a surface treatment, and this metal material can be used for an automobile body, automobile components, home appliance, building material, and the like.

BACKGROUND ART

Corrosion resistance before and after coating of the metal material has generally been improved by using a surface-treated metal material having a zinc phosphate or a chromate coating. A zinc phosphate coating is capable of improving the corrosion resistance of steel materials such as a hot-rolled steel strip and a cold-rolled steel strip, galvanized steel strip, and some aluminum alloys.

However, the surface treatment used in forming such a zinc phosphate coating is associated with the inevitable generation of sludge which is the by-product of the reaction, and the corrosion resistance after coating had been insufficient in some steel materials such as a high tensile strength steel strip and some aluminum alloys.

Galvanized steel strips and aluminum alloys can also be provided with sufficient performance after coating by forming a chromate coating on such a material.

However, in consideration of current environmental regulation, use of the chromate treatment which inevitably includes toxic hexavalent chromium in both the treatment solution and the coating layer formed by such treatment is gradually avoided. Because of such a situation, various methods including the methods as described below have been proposed as a method capable of providing a coating layer free from toxic components by a surface treatment.

For example, Patent Document 1 discloses a compound containing a nitrogen atom having a lone pair, and a chromium-free coating composition for a metal surface containing this compound and a zirconium compound. This method discloses the application of the compound to provide a coating containing no harmful hexavalent chromium and having an improved corrosion resistance after coating as well as a satisfactory adhesion.

Similarly, many chemical conversion methods such as those disclosed in Patent Documents 2 to 5 were proposed as surface-treatment methods for depositing a coating exhibiting an excellent adhesion after the coating as well as an excellent corrosion resistance.

Patent Document 6 discloses a composition for surface treatment of a metal containing a metal acetylacetonate and at least one compound selected from a water-soluble inorganic titanium compound and a water-soluble zirconium compound at a weight ratio of 1:5000 to 5000:1.

Patent Document 7 discloses a surface-coated metal material having an excellent corrosion resistance produced by forming on the surface of a metal material a corrosion-resistant coating containing an oxide of at least one element selected from the group consisting of Ti, Cr, Nb, Ta, Al, Si, and Zr and a carbide of at least one element selected from the group consisting of Ti, V, Al, Cr, Si, W, Ta, Fe, and Zr in a total content of at least 10% by weight. Patent Document 7 also teaches that a metal material having an excellent corrosion resistance can be provided by this coating.

Patent Document 1 JP 2000-204485 A

Patent Document 2 JP 56-136978 A

Patent Document 3 JP 8-176841 A

Patent Document 4 JP 9-25436 A

Patent Document 5 JP 9-31404 A

Patent Document 6 JP 2000-199077 A

Patent Document 7 JP 7-228961 A

DISCLOSURE OF THE INVENTION

Problems to be Solved by the Invention

Despite the attempts as described above, the metal material treated in Patent Document 1 was an aluminum alloy and the metal materials treated in Patent Documents 2 to 5 were aluminum alloys inherently having a high corrosion resistance. In other words, these attempts were substantially incapable of improving the corrosion resistance of iron-based metal materials and zinc-based metal materials.

The metal materials treated in Patent Document 6 were aluminum alloys, magnesium, magnesium alloys, zinc and galvanized alloys, and Patent Document 6 was substantially incapable of improving the corrosion resistance of the iron-based metal materials.

The method disclosed in Patent Document 7 substantially required formation on the surface of a metal material of two layers including a layer of an oxide of at least one element selected from the group consisting of Ti, Cr, Nb, Ta, Al, Si and Zr and a layer of a carbide of at least one element selected from the group consisting of Ti, V, Al, Cr, Si, W, Ta, Fe and Zr, and these layers had to be formed by a special method such as heat treatment or sputtering.

An object of the present invention is to provide a metal material having a coating formed by a surface treatment on an iron-based metal material such as a hot-rolled steel strip or a cold-rolled steel strip, or a zinc-based metal material such as a galvanized steel strip, wherein the coating has an excellent corrosion resistance, with or without a further coating, that is equivalent or superior to the prior art coating formed by zinc phosphate treatment or chromate treatment, and the coating is free from sludge formation or environmentally harmful components and is formed by using a component capable of deposition with a simple method.

Means to Solve the Problems

In order to solve the problems as described above, the inventors of the present invention made an intensive study and completed a surface treated metal material that had not conventionally been seen.

Accordingly, the present invention provides the following (1) to (6).

(1) A surface-treated metal material having on a surface of a metal material a coating layer formed by a surface treatment, the coating layer comprising the following component (A) and component (B):

(A) an oxide and/or hydroxide of at least one metallic element selected from the group consisting of Ti, Zr and Hf; and (B) aluminum;

wherein, in the coating layer formed by the surface treatment, the weight ratio $K_1$ (=B/A), which is the weight ratio of the coating weight B of aluminum of the component (B) to the total coating weight A of the metallic element in the component (A), is in the range of $0.001 \leqq K_1 \leqq 2$.

(2) The surface-treated metal material according to (1) above, wherein the aluminum constituting the component (B) is derived from an inorganic material.

(3) The surface-treated metal material according to (1) or (2) above, wherein the total coating weight, which is the sum of the total coating weight A and the coating weight B, is in the range of 20 to 1000 mg/m$^2$.

(4) The surface-treated metal material having the coating layer formed by the surface treatment according to any one of (1) to (3), wherein the coating layer further comprises the following component (C):

(C) at least one metallic element selected from the group consisting of Zn, Ca and Mg and, wherein, in the coating layer formed by the surface treatment, the weight ratio $K_2$ (=C/A), which is the weight ratio of the total coating weight C of the metallic element of the component (C) to the total coating weight A, is in the range of $0<K_2\leqq 1$.

(5) The surface-treated metal material having the coating layer formed by the surface treatment according to any one of (1) to (4), wherein the coating layer further comprises the following component (D):

(D) is at least one polymeric compound and, wherein, in the coating layer formed by the surface treatment, the weight ratio $K_3$ (=D/A), which is the weight ratio of the total coating weight D of the polymeric compound of the component (D) to the total coating weight A, is in the range of $0<K_3\leqq 1$.

(6) The surface-treated metal material according to any one of (1) to (5), wherein the metal material has a coating layer obtained by the surface treatment which comprises bringing the surface of the metal material into contact with an aqueous solution that contains (a) at least one metallic element selected from the group consisting of Ti, Zr and Hf; (b) aluminum and (e) fluorine, and has a concentration of the metallic element (a) of 5 to 5000 ppm, a molar concentration ratio of fluorine (e) to the metallic element (a) of at least 6 and a molar concentration ratio of aluminum (b) to fluorine (e) of 0.05 to 1.0.

EFFECTS OF THE INVENTION

The present invention is a breakthrough which provides a metal material having a coating formed by a surface treatment on an iron-based metal material such as a hot-rolled steel strip or a cold-rolled steel strip, or a zinc-based metal material such as a galvanized steel strip, the coating having an excellent corrosion resistance with or without a further coating, is free from environmentally harmful components and is formed by using a component capable of deposition with a simple method.

BEST MODE FOR CARRYING OUT THE INVENTION

The present invention provides a surface-treated metal material having on a surface of a metal material a coating layer formed by a surface treatment, the coating layer comprising the following component (A) and component (B):

(A) oxide and/or hydroxide of at least one metallic element selected from the group consisting of Ti, Zr and Hf; and (B) aluminum;

wherein, in the coating layer formed by the surface treatment, the weight ratio $K_1$ (=B/A), which is the weight ratio of the coating weight B of aluminum of the component (B) to the total coating weight A of the metallic element in the component (A), is in the range of $0.001\leqq K_1\leqq 2$.

This surface-treated metal material is hereinafter referred to as the "surface-treated metal material of the present invention".

<Metal Material>

The surface-treated metal material of the present invention has a coating layer formed by a surface treatment on the surface of the metal material, and the coating layer contains the components as will be described below.

The metal material which may be used include iron-based metal materials, zinc-based metal materials, aluminum-based materials, and magnesium-based materials.

The iron-based metal materials include steel strips such as cold-rolled steel strips and hot-rolled steel strips, and specialty steels such as bar steels, shaped steels, steel strips, steel tubes, wires, cast and forged steels, and bearing steels.

The zinc-based metal materials include zinc die castings and zinc-based plated metal materials.

The zinc-based plated metal material is a metal material plated on its surface with zinc or zinc and another metal such as at least one member selected from nickel, iron, aluminum, manganese, chromium, magnesium, cobalt, lead and antimony (including inevitable impurities). The method used for the plating is not limited, and exemplary methods include hot-dipping, electroplating, and vapor deposition.

The aluminum-based materials include plates of aluminum alloys such as 5000 series aluminum alloys and 6000 series aluminum alloys, and aluminum alloy die castings such as ADC-12.

The magnesium-based materials include plates and die castings prepared by using magnesium alloys.

The metal material used in the present invention may be an iron-based metal material, a zinc-based metal material, an aluminum-based metal material, or a magnesium-based metal material, which may be used alone or in combination of two or more. When two or more metal materials are used, they may be used in the state where the metal materials are not in contact with each other or in the state where the metal materials are secured by welding, adhesion, or riveting to be in contact with each other.

In the present invention, use of at least one of the iron-based metal materials and the zinc-based metal materials is preferred.

The metal material of the present invention is used for an automobile body, automobile parts, home appliances, building materials, and the like and, therefore, the metal material of the present invention may be combined with various coatings such as cationic electrodeposition, anionic electrodeposition, powder coating, solvent coating, ceramic coating, and the like.

The surface-treated metal material of the present invention has a coating layer formed by a surface treatment on the surface of such metal material. The coating layer contains the following components (A) and (B):

(A) an oxide and/or hydroxide of at least one metallic element selected from the group consisting of Ti, Zr and Hf and (B) aluminum.

<Components>

The component (A) included in the coating layer formed by a surface treatment in the surface-treated metal material of the present invention is an oxide and/or hydroxide of at least one metallic element selected from the group consisting of Ti, Zr and Hf.

The component (B) included in the coating layer formed by a surface treatment in the surface-treated metal material of the present invention is aluminum element.

The component (A), namely the oxide and/or hydroxide of the metallic element is chemically stable with an improved acid and alkali resistance and, therefore, the inclusion of this component in the coating layer provided for the purpose of improving the corrosion resistance is favorable from the chemical point of view.

However, the oxide and/or hydroxide of the metallic element in the component (A) is hard and brittle and, when the compound is used alone, the resulting coating layer is likely to suffer from defects such as cracks and peeling.

Also, in the case where a metal material whose surface has a thick oxidized film is used to form a coating layer, the surface of the surface-treated metal material is likely to suffer from defects such as cracks and peeling for similar reasons.

The corrosion most typically found in a metal material is the corrosion of an oxygen-demanding type that proceeds in the presence of water and oxygen, and the speed of this corrosion is accelerated in the presence of a substance such as a chloride.

Accordingly, the metal material becomes highly susceptible to corrosion once cracks and peeling have occurred in the coating layer to permit free access of water, oxygen and corrosion-promoting substances such as a chloride to the metal material.

The inventors of the present invention found that such cracks and peeling of the coating layer can be prevented when the component (B), namely, the aluminum element, is incorporated in a predetermined content in the coating layer comprising the component (A), namely, an oxide and/or hydroxide of an metallic element.

The inventors of the present invention analyzed the coating layer of the surface-treated metal material of the present invention with an X-ray photoelectron spectroscopy (XPS). It was then found that aluminum, which is the component (B), is present in the coating layer in a trivalent state irrespective of whether the treated substrate was an iron-based metal material, zinc-based metal material, aluminum-based material, or magnesium-based material.

At present, it has not yet been found out to which element the trivalent aluminum is bound. However, it is estimated that the trivalent aluminum is present as aluminum fluoride, oxide, or hydroxide in the coating layer containing the oxide and/or hydroxide of the metallic element (component (A)), and this aluminum compound reduces the stress of the coating layer to prevent the occurrence of the cracks and peeling of the coating layer.

The coating layer containing the component (A), namely, the oxide and/or hydroxide of the metallic element, and the component (B), namely, aluminum, is free from cracks and peeling. As a consequence, this coating layer acts as a barrier that prevents contact of the metal material with water, oxygen and corrosion promoters such as chlorides. The excellent corrosion resistance is presumably realized by this mechanism.

In addition, the component (A), namely, the oxide and/or hydroxide of an metallic element, is highly resistant to acids and alkalis and chemically stable as described above. In the course of metal corrosion, the pH reduces at the anode where the metal dissolution (oxidation) takes place, while the pH increases at the cathode where the reduction which is the reaction corresponding to the oxidation takes place. Accordingly, if the coating layer is inferior in resistance to acids and alkalis, it will dissolve under corrosive conditions to lose its function. The coating layer of the present invention, however, is chemically stable, and it will perform its excellent function under the corrosive conditions.

In order to form a consistent coating layer which is free from cracks and peeling, the composition of the coating layer should be controlled such that the weight ratio $K_1$ (=B/A), which is the weight ratio of the coating weight B of aluminum of the component (B) to the total coating weight A of the metallic element(s) in the component (A), is in the range of $0.001 \leqq K_1 \leqq 2$.

When $K_1$ is excessively small, the content of the component (B) in the coating layer will be insufficient and the occurrence of the defects in the coating layer will not be fully suppressed. On the other hand, an excessively large $K_1$ will invite the loss of the corrosion resistance.

The surface-treated metal material of the present invention may preferably have a total coating weight, namely, a sum of the total coating weight A and the coating weight B, of 20 to 1000 mg/m$^2$, more preferably 30 to 500 mg/m$^2$ and, still more preferably 40 to 200 mg/m$^2$.

When the total coating weight is below the above range, the barrier effect of the coating layer will be insufficient and the corrosion resistance will be reduced. On the other hand, an excessively high total coating weight will not significantly enhance the effect and be economically disadvantageous, although the corrosion resistance will be improved.

The surface-treated metal material of the present invention is preferably a surface-treated metal material having the coating layer formed by the surface treatment, wherein the coating layer further comprises the following component (C):

(C) at least one metallic element selected from the group consisting of Zn, Ca and Mg, and, wherein, in the coating layer formed by the surface treatment, the weight ratio $K_2$ (=C/A), which is the weight ratio of the total coating weight C of the metallic element of the component (C) to the total coating weight A, is in the range of $0 < K_2 \leqq 1$.

When the component (C) is included in the coating in such a manner that its content satisfies the range of $K_2$, the surface-treated metal material of the present invention will have an improved corrosion resistance.

The surface-treated metal material of the present invention is preferably a surface-treated metal material having the coating layer formed by the surface treatment, wherein the coating layer further comprises the following component (D):

(D) at least one polymeric compound and, wherein, in the coating layer formed by the surface treatment, the weight ratio $K_3$ (=D/A), which is the weight ratio of the total coating weight D of the polymeric compound of the component (D) to the total coating weight A, is in the range of $0 < K_3 \leqq 1$.

When the component (D) is included in the coating in such a manner that its content satisfies the range of $K_3$, the surface-treated metal material of the present invention will have an improved corrosion resistance and, also, an improved lubricity and abrasion resistance.

The polymeric compound used is not particularly limited as long as it can be incorporated in the coating layer formed by a surface treatment in the surface-treated metal material of the present invention.

In view of improving the corrosion resistance and adhesion of the coating, preferable examples of the polymeric compound include polyvinyl alcohol, poly(meth)acrylic acid, a copolymer of acrylic acid and methacrylic acid, a copolymer of ethylene and an acrylic monomer such as (meth)acrylic acid and (meth)acrylate; a copolymer of ethylene and vinyl acetate; polyurethane, amino-modified phenol resin, polyvinylamine, polyallylamine, polyester resin, epoxy resin, chitosan and its compounds; tannin, tannic acid, and its salt; and phytic acid, and naphthalenesulfonic acid polymer.

Preferably, the component (D) that may be used is at least one polymeric compound selected from the group consisting of these polymeric compounds.

Next, the method for producing the surface-treated metal material of the present invention is described.

The method used for producing the surface-treated metal material of the present invention is not particularly limited, and any treatment can be used as long as the coating layer formed by a surface treatment and containing the components as described above can be provided on the surface of the metal material.

Exemplary methods include chemical conversion wherein the coating layer is deposited by a chemical reaction; a method wherein a solution containing the components corresponding those of the coating layer is applied on the surface of the metal material followed by drying-in-place; vapor deposition; and a sol-gel method wherein the metal material is immersed in an aqueous solution prepared by hydrolyzing a metal alkoxide and the metal material is then recovered from the solution to thereby deposit the components of the coating on the surface of the metal material.

When the metal material used in the present invention is an article having an intricate shape, the metal material is preferably treated by chemical conversion in view of fully covering the article with the coating. Use of chemical conversion also has the merit that the coating layer is firmly adhered to the surface of the metal material since the coating is formed by a chemical reaction on the surface of the metal material.

The chemical conversion may be accomplished, for example, by spraying the surface-treating solution on the surface of the metal material, by immersing the metal material in the surface-treating solution, or by allowing the surface-treating solution to flow over the surface of the metal material.

The surface-treating solution used in the present invention for depositing the surface coating by chemical conversion wherein the coating layer is deposited by the chemical reaction as described above or by coating the surface of the metal material with the solution comprising the components corresponding to those of the coating layer to be formed followed by drying-in-place is preferably an aqueous solution containing (a) at least one metallic element selected from the group consisting of Ti, Zr and Hf, (b) aluminum and (e) fluorine, wherein the metallic element (a) is included at a concentration of 5 to 5000 ppm, the ratio of the molar concentration of fluorine (e) to that of the metallic element (a) is at least 6, and the ratio of the molar concentration of aluminum (b) to that of fluorine (e) is 0.05 to 1.0.

When the coating layer of the present invention is produced by a chemical reaction using this aqueous solution for the surface-treating solution, components other than the at least one metallic element (a) selected from the group consisting of Ti, Zr and Hf, and aluminum (b), for example, fluorine (e) may become incorporated in the coating layer. However, when $K_1$ (B/A) in the coating layer is within the range as described above, the coating is not affected by this additional element, and the resulting coating layer will be uniform with no cracks or peeling.

In order to obtain the coating layer having the $K_1$ within the range as defined above, the aqueous solution used preferably has a molar concentration ratio of aluminum (b) to fluorine (e) in the range of 0.05 to 1.0, preferably 0.1 to 0.7, and more preferably 0.2 to 0.6.

Use of such an aqueous solution facilitates the formation of the coating layer having the $K_1$ in the range of 0.001 to 2.

The method used for providing the component (A), namely, the at least one metallic element selected from the group consisting of Ti, Zr and Hf, to the surface-treating solution is not particularly limited and exemplary methods include the inclusion of $TiCl_4$, $Ti(SO_4)_2$, $TiOSO_4$, $Ti(NO_3)_4$, $TiO(NO_3)_2$, $Ti(OH)_4$, $TiO_2OC_2O_4$, $H_2TiF_6$, or a salt of $H_2TiF_6$; TiO, $TiO_2$, $Ti_2O_3$, $TiF_4$, $ZrCl_4$, $ZrOCl_2$, $Zr(OH)_2Cl_2$, $Zr(OH)_3Cl$, $Zr(SO_4)_2$, $ZrOSO_4$, $Zr(NO_3)_4$, $ZrO(NO_3)_2$, $Zr(OH)_4$, $H_2ZrF_6$, or a salt of $H_2ZrF_6$; $H_2(Zr(CO_3)_2(OH)_2)$ or a salt of $H_2(Zr(CO_3)_2(OH)_2)$; $H_2Zr(OH)_2(SO_4)_2$ or a salt of $H_2Zr(OH)_2(SO_4)_2$; $ZrO_2$, $ZrOBr_2$, $ZrF_4$, $HfCl_4$, $Hf(SO_4)_2$, $H_2HfF_6$, or a salt of $H_2HfF_6$; $HfO_2$ or $HfF_4$ in the surface-treating solution.

The method used for providing the component (B), namely, aluminum, to the surface-treating solution is not particularly limited, and exemplary methods include inclusion of aluminum derived from an inorganic material in the surface-treating solution. More specifically, the aluminum is preferably derived from at least one inorganic material selected from the group consisting of $AlCl_3$, $Al_2(SO_4)_3$, $Al(NO_3)_3$, $Al(OH)_3$, $Al_2O_3$, $AlF_3$, $AlPO_4$, $Al(H_2PO_4)_3$, $Na_3AlO_3$, $NaAlO_2$, $Na[Al(OH)_4]$, $Na_3AlF_6$, $AlBr_3$, $AlI_3$, $KAl(SO_4)_2 12H_2O$, and AlN.

The source used for providing the component (C), namely, the at least one metallic element selected from the group consisting of Zn, Ca and Mg to the surface-treating solution is not particularly limited, and exemplary sources include chloride, sulfate, nitrate, hydroxide, oxide, carbonate, fluoride, and organic acid salts of Zn, Ca and Mg, which may be used either alone or in combinations of two or more.

The present invention relates to a metal material having a coating layer formed by a surface treatment which has excellent corrosion resistance with or without further coating, and this metal material can be used for an automobile body, automobile parts, home appliances, building materials, and the like.

EXAMPLES

Next, the benefit of the surface-treated metal material of present invention is described in further detail by referring to the Examples and Comparative Examples. The metal material, the degreasing agent, the reagents used for chemical conversion, and the coating composition were adequately selected from commercially available materials and reagents, and they do not limit the actual application of the surface-treated metal material of the present invention.

<Test Plate>

Abbreviation and specification of the test plates used in the Examples and the Comparative Examples are as described below.

SPC (cold-rolled steel strip, JIS-G-3141)

GA (hot-dipped galvanized steel strip having an alloy coating on both surfaces; coating weight, 45 g/m$^2$)

<Treatment Procedure>

The surface treatment in Examples 1 to 3 and 5 to 13 and Comparative Examples 1 to 3 was carried out by the procedure as described below.

Alkali degreasing→rinsing with water→formation of the coating by chemical conversion→rinsing with water→rinsing with pure water→drying with hot air (90° C., 5 minutes)

The surface treatment in Example 4 was carried out by the procedure as described below.

Alkali degreasing→rinsing with water→formation of the coating by chemical conversion→rinsing with water→rinsing with pure water→drying with cold air (drying at room temperature, about 5 minutes)

In both the Examples and Comparative Examples, the alkali degreasing was conducted by diluting FINECLEANER E2001 (registered trademark, manufactured by Nihon Parkerizing Co., Ltd.) to 2% with tap water, and spraying the test plate with the resulting aqueous solution heated to 40° C. for 120 seconds.

In both the Examples and Comparative Examples, the rinsing with water and the rinsing with pure water were conducted by spraying the test plate with water or pure water at room temperature for 30 seconds.

In Examples 5 and 10 and Comparative Example 2, the test plate before the alkali degreasing was heated for 10 minutes in a drier which had been heated to 90° C. to thereby change the surface condition of the metal material to be treated.

<Chemical Conversion of the Coating>

Example 1

Aluminum nitrate reagent was added to an aqueous solution of hexafluorotitanium to prepare a solution having a titanium concentration of 200 ppm, an aluminum concentration of 50 ppm, and a ratio of the molar concentration of aluminum to the molar concentration of fluorine of 0.074. An ammonia reagent was added to this solution to adjust the pH to 3.5 and the solution was heated to 50° C. This solution was used for the surface-treating solution in Example 1.

The test plate was immersed in this surface-treating solution to prepare a surface-treated metal material having the coating layer formed by the surface treatment on its surface. The test plate had the $K_1$ and the coating weight as shown in Table 1.

Example 2

Aluminum nitrate reagent and hydrofluoric acid were added to an aqueous solution of zirconium nitrate to prepare a solution having a zirconium concentration of 50 ppm, an aluminum concentration of 50 ppm, and a ratio of the molar concentration of the aluminum element to the molar concentration of the fluorine element of 0.47. Ammonia reagent was added to this solution to adjust the pH to 4.5 and the solution was heated to 50° C. This solution was used for the surface-treating solution in Example 2.

The test plate was immersed in this surface-treating solution to prepare a surface-treated metal material having the coating layer formed by the surface treatment on its surface. The test plate had the $K_1$ and the coating weight as shown in Table 1.

Example 3

Hexafluorotitanium aqueous solution, aluminum nitrate reagent, and hydrofluoric acid were added to an aqueous solution of zirconium nitrate to prepare a solution having a zirconium concentration of 100 ppm, a titanium concentration of 100 ppm, an aluminum concentration of 400 ppm, and a ratio of the molar concentration of aluminum to the molar concentration of fluorine of 0.34. Ammonia reagent was added to this solution to adjust the pH to 3.0, and the solution was heated to 45° C. This solution was used for the surface-treating solution in Example 3.

The test plate was immersed in this surface-treating solution to prepare a surface-treated metal material having the coating layer formed by the surface treatment on its surface. The test plate had the $K_1$ and the coating weight as shown in Table 1.

Example 4

Hafnium oxide reagent, aluminum nitrate reagent, and hydrofluoric acid were added to an aqueous solution of zirconium nitrate to prepare a solution having a zirconium concentration of 200 ppm, a hafnium concentration of 20 ppm, an aluminum concentration of 500 ppm, and a ratio of the molar concentration of aluminum to the molar concentration of fluorine of 0.50. Ammonia reagent was added to this solution to adjust the pH to 4.5, and the solution was heated to 50° C. This solution was used for the surface-treating solution in Example 4.

The test plate was immersed in this surface-treating solution to prepare a surface-treated metal material having the coating layer formed by the surface treatment on its surface. The test plate had the $K_1$ and the coating weight as shown in Table 1.

Example 5

Aluminum nitrate reagent and hydrofluoric acid were added to an aqueous solution of hexafluorotitanium to prepare a solution having a titanium concentration of 500 ppm, an aluminum concentration of 1500 ppm, and a ratio of the molar concentration of aluminum to the molar concentration of fluorine of 0.59. Ammonia reagent was added to this solution to adjust the pH to 3.0, and the solution was heated to 50° C. This solution was used for the surface-treating solution in Example 5.

The test plate was immersed in this surface-treating solution to prepare a surface-treated metal material having the coating layer formed by the surface treatment on its surface. The test plate had the $K_1$ and the coating weight as shown in Table 1.

Example 6

Aluminum nitrate reagent and hydrofluoric acid were added to an aqueous solution of zirconium nitrate to prepare a solution having a zirconium concentration of 2000 ppm, an aluminum concentration of 3000 ppm, and a ratio of the molar concentration of aluminum to the molar concentration of fluorine of 0.53. Ammonia reagent was added to this solution to adjust the pH to 4.5, and the solution was heated to 40° C. This solution was used for the surface-treating solution in Example 6.

The test plate was immersed in this surface-treating solution to prepare a surface-treated metal material having the coating layer formed by the surface treatment on its surface. The test plate had the $K_1$ and the coating weight as shown in Table 1.

Example 7

Calcium nitrate reagent, aluminum nitrate reagent, and hydrofluoric acid were added to an aqueous solution of zirconium nitrate to prepare a solution having a zirconium concentration of 100 ppm, a calcium concentration of 10 ppm, an aluminum concentration of 20 ppm, and a ratio of the molar concentration of aluminum to the molar concentration of fluorine of 0.07. Ammonia reagent was added to this solution to adjust the pH to 5.0, and the solution was heated to 35° C. This solution was used for the surface-treating solution in Example 7.

The test plate was immersed in this surface-treating solution to prepare a surface-treated metal material having the coating layer formed by the surface treatment on its surface. The test plate had the $K_1$, $K_2$ and the coating weight as shown in Table 1.

Example 8

An aqueous solution of hexafluorotitanium, calcium nitrate reagent, zinc sulfate reagent, aluminum nitrate reagent and hydrofluoric acid were added to an aqueous solution of zirconium nitrate to prepare a solution having a zirconium concentration of 20 ppm, a titanium concentration of 20 ppm, a calcium concentration of 5 ppm, a zinc concentration of 500 ppm, an aluminum concentration of 50 ppm, and a ratio of the molar concentration of aluminum to the molar concentration of fluorine of 0.24. Ammonia reagent was added to this solution to adjust the pH to 4.0 and the solution was heated to 45° C. This solution was used for the surface-treating solution in Example 8.

The test plate was immersed in this surface-treating solution to prepare a surface-treated metal material having the coating layer formed by the surface treatment on its surface. The test plate had the $K_1$, $K_2$ and the coating weight as shown in Table 1.

Example 9

Hafnium oxide reagent, calcium nitrate reagent, magnesium nitrate reagent, aluminum nitrate reagent and hydrofluoric acid were added to an aqueous solution of hexafluorotitanium to prepare a solution having a titanium concentration of 3000 ppm, a hafnium concentration of 2000 ppm, a calcium concentration of 20 ppm, a magnesium concentration of 500 ppm, an aluminum concentration of 1500 ppm and a ratio of the molar concentration of aluminum to the molar concentration of fluorine of 0.12. Ammonia reagent was added to this solution to adjust the pH to 4.0 and the solution was heated to 45° C. This solution was used for the surface-treating solution in Example 9.

The test plate was immersed in this surface-treating solution to prepare a surface-treated metal material having the coating layer formed by the surface treatment on its surface. The test plate had the $K_1$, $K_2$ and the coating weight as shown in Table 1.

Example 10

Magnesium nitrate reagent, zinc sulfate reagent, aluminum nitrate reagent and hydrofluoric acid were added to an aqueous solution of zirconium nitrate to prepare a solution having a zirconium concentration of 100 ppm, a magnesium concentration of 1000 ppm, a zinc concentration of 2000 ppm, an aluminum concentration of 200 ppm and a ratio of the molar concentration of aluminum to the molar concentration of fluorine of 0.35. Ammonia reagent was added to this solution to adjust the pH to 4.2 and the solution was heated to 50° C. This solution was used for the surface-treating solution in Example 10.

The test plate was immersed in this surface-treating solution to prepare a surface-treated metal material having the coating layer formed by the surface treatment on its surface. The test plate had the $K_1$, $K_2$, and the coating weight as shown in Table 1.

Example 11

Hafnium oxide reagent, calcium nitrate, commercially available naphthalenesulfonic acid, aluminum nitrate reagent and hydrofluoric acid were added to an aqueous solution of zirconium nitrate to prepare a solution having a zirconium concentration of 100 ppm, a hafnium concentration of 50 ppm, a calcium concentration of 15 ppm, a naphthalenesulfonic acid concentration in terms of solid content of 50 ppm, an aluminum concentration of 25 ppm and a ratio of the molar concentration of aluminum to the molar concentration of fluorine of 0.09. Ammonia reagent was added to this solution to adjust the pH to 3.0, and the solution was heated to 50° C. This solution was used for the surface-treating solution in Example 11.

The test plate was immersed in this surface-treating solution to prepare a surface-treated metal material having the coating layer formed by the surface treatment on its surface. The test plate had the $K_1$, $K_2$, $K_3$, and the coating weight as shown in Table 1.

Example 12

Magnesium nitrate reagent, commercially available aqueous solution of polyallylamine, commercially available aqueous solution of chitosan, aluminum nitrate reagent and hydrofluoric acid were added to an aqueous solution of zirconium nitrate to prepare a solution having a zirconium concentration of 100 ppm, a magnesium concentration of 1500 ppm, a concentration of the commercially available polyallylamine in terms of solid content of 50 ppm, a concentration of the commercially available aqueous solution of chitosan in terms of solid content of 50 ppm, an aluminum concentration of 150 ppm and a ratio of the molar concentration of aluminum to the molar concentration of fluorine of 0.30. Ammonia reagent was added to this solution to adjust the pH to 4.0 and the solution was heated to 45° C. This solution was used for the surface-treating solution in Example 12.

The test plate was immersed in this surface-treating solution to prepare a surface-treated metal material having the coating layer formed by the surface treatment on its surface. The test plate had the $K_1$, $K_2$, $K_3$, and the coating weight as shown in Table 1.

Example 13

Aluminum sulfate and hydrofluoric acid were added to an aqueous solution of hexafluorozirconium to prepare a solution having a zirconium concentration of 5 ppm, an aluminum concentration of 5 ppm and a ratio of the molar concentration of aluminum to the molar concentration of fluorine of 0.05. Ammonia reagent was added to this solution to adjust the pH to 4.5 and the solution was heated to 35° C. This solution was used for the surface-treating solution in Example 13.

The test plate was immersed in this surface-treating solution to prepare a surface-treated metal material having the coating layer formed by the surface treatment on its surface. The test plate had the $K_1$ and the coating weight as shown in Table 1.

Comparative Example 1

An aqueous solution prepared by diluting a commercially available chromic chromating agent (ALCHROM 713 (registered trademark; manufactured by Nihon Parkerizing Co., Ltd.) to 3.6% with tap water was heated to 50° C. and this solution was used for the surface-treating solution in Comparative Example 1. The test plate was immersed in this surface-treating solution for 1 minute to prepare a surface-treated metal material having a chromium coating weight of 30 mg/m$^2$.

Comparative Example 2

Titanium (IV) sulfate reagent and hydrofluoric acid were mixed to prepare an aqueous solution having a titanium concentration of 100 ppm and a molar concentration ratio of fluorine to the titanium of 3.8. Ammonia reagent was added to this solution to adjust the pH to 4.5 and the solution was heated to 40° C. This solution was used for the surface-treating solution in Comparative Example 2.

The test plate was immersed in this surface-treating solution to prepare a surface-treated metal material having the coating layer formed by the surface treatment on its surface. The test plate had the coating weight as shown in Table 1.

Comparative Example 3

Hafnium oxide reagent, aluminum nitrate reagent and hydrofluoric acid were added to an aqueous solution of zirconium nitrate to prepare a solution having a zirconium concentration of 50 ppm, a hafnium concentration of 200 ppm, an aluminum concentration of 500 ppm and a ratio of the molar concentration of aluminum to the molar concentration of fluorine of 1.76. Ammonia reagent was added to this solution to adjust the pH to 4.5 and the solution was heated to 50° C. This solution was used for the surface-treating solution in Comparative Example 3.

The test plate was immersed in this surface-treating solution to prepare a surface-treated metal material having the coating layer formed by the surface treatment on its surface. The test plate had the $K_1$ and the coating weight as shown in Table 1.

<Evaluation of the Coating Formed by the Surface Treatment and Measurement of the Coating Weight>

The outer appearance of each of the surface-treated test plates produced in the Examples and the Comparative Examples was evaluated by visual inspection and the coating weight of the coating layer formed by the surface treatment was determined by using X-ray fluorescence analysis system (XRF-1800 manufactured by Shimadzu Corporation).

<Preparation of Test Plate for Evaluating Paintability>

Surface-treated test plates produced in the Examples and the Comparative Examples were evaluated for their paintability by the following procedure:

Cationic electrodeposition→rinsing with pure water→baking→intermediate coating→baking→top coating→baking Cationic electrodeposition: epoxy coating composition for cationic electrodeposition (Elecron 9400, manufactured by Kansai Paint Co., Ltd.); voltage, 200 V; coating thickness, 20 μm; baking at 175° C. for 20 minutes.

Intermediate coating: aminoalkyd coating (Amilac TP-37, gray, manufactured by Kansai Paint Co., Ltd.), spray coating, coating thickness, 35 μm; baking at 140° C. for 20 minutes.

Top coating: aminoalkyd coating (Amilac TM-13, white, manufactured by Kansai Paint Co., Ltd.), spray coating, coating thickness, 35 μm; baking at 140° C. for 20 minutes.

<Evaluation of Paintability>

The test plates produced in the Examples and Comparative Examples were also evaluated for their paintability. The items evaluated and abbreviations are as described below. The coating immediately after the completion of the cationic electrodeposition is referred to as the electrodeposited coating, and the coating immediately after the completion of the top coating is referred to as the three-coat coating.

(i) SST: salt spray test (electrodeposited coating)

(ii) $1^{st}$ ADH: primary adhesion (three-coat coating)

(iii) $2^{nd}$ ADH: water-resistant secondary adhesion (three-coat coating)

<SST>

The electrodeposited plate having cross-cuts formed with a sharp knife was sprayed with 5% aqueous solution of sodium chloride for 840 hours (according to JIS-Z-2371). After completing the spraying, maximum blister width (both sides) was measured from the cross-cut portion.

<Maximum Blister Width (Both Sides)> less than 4 mm: A at least 4 mm to less than 6 mm: B at least 6 mm to less than 10 mm: C at least 10 mm: D <$1^{st}$ ADH>

The three-coat coating was cut with a sharp knife in both length and breadth directions at intervals of 2 mm to form 100 squares. An adhesive tape was applied onto the squares and then peeled for evaluation to count the number of peeled squares.

<$2^{nd}$ ADH>

The three-coat coating was immersed in deionized water at 40° C. for 240 hours. After the immersion, the three-coat coating was cut with a sharp knife in both length and breadth directions at intervals of 2 mm to form 100 squares. An adhesive tape was applied onto the squares and then peeled for evaluation to count the number of peeled squares.

Table 1 shows the results of the evaluation of the outer appearance and coating weight of the coating layer obtained in the Examples and the Comparative Examples. All coating layers formed by the surface treatment in the Examples were uniform in their appearance.

The results of the salt spray test for the electrodeposited plate and the results of the adhesion test for the three-coat plate are shown in Table 2. In the salt spray test, the corrosion resistance was satisfactory at all levels and in all test plates of the Examples. The corrosion resistance was satisfactory even at the level wherein the test plate before the alkali degreasing was heated for 10 minutes in a drier which had been heated to 90° C. to thereby change the surface condition of the test plate (Examples 5 and 10) since both $K_1$ (the ratio of the component (B) to the component (A) and the sum of the coating weights of the component (A) and the component (B) were within the ranges defined in the claims. In contrast, Comparative Example 1 exhibited a corrosion resistance which was clearly inferior to that of the Examples although a chromating agent was used for the surface-treating solution. Comparative Example 2 failed to exhibit a satisfactory corrosion resistance and the coating formed had minute defects probably because the test piece was heated in a drier before the alkali degreasing and the coating did not contain the component (B). Comparative Example 3 failed to exhibit a satisfactory corrosion resistance since $K_1$ (the ratio of the component (B) to the component (A)) was in excess of the range defined in the claims while the sum of the component (A) and the component (B) was within the range defined in the claims.

In the evaluation of the adhesion of the three-coat plate, the test plates exhibited excellent adhesion in all the Examples. In contrast, the test plates of the Comparative Examples exhibited good results for the $1^{ST}$ ADH while all test plates of the Comparative Examples were insufficient in the $2^{nd}$ ADH as in the case of the corrosion resistance of the electrodeposited plate.

As demonstrated by the results as described above, the surface-treated metal material according to the present invention has superior corrosion resistance and adhesion compared to prior art metal materials.

Table 1

TABLE 1

Characteristic features of the surface coating

| | Test plate | Outer appearance | Component (A) | Component (C) | Component (D) | $K_1$ | Coating weight (A) + (B) mg/m$^2$ | $K_2$ | $K_3$ | Note |
|---|---|---|---|---|---|---|---|---|---|---|
| EX 1 | GA | Consistent grayish black color | Ti | — | — | 0.002 | 28 | — | — | |
| EX 2 | SPC | Consistent interference color | Zr | — | — | 0.03 | 63 | — | — | |
| EX 3 | GA | Consistent grayish black color | Ti + Zr | — | — | 0.15 | 65 | — | — | |
| EX 4 | SPC | Consistent interference color | Zr + Hf | — | — | 0.72 | 122 | — | — | * |
| EX 5 | GA | Consistent grayish black color | Ti | — | — | 1.24 | 92 | — | — | |
| EX 6 | SPC | Consistent interference color | Zr | — | — | 1.38 | 632 | — | — | |
| EX 7 | GA | Consistent grayish black color | Zr | Ca | — | 0.003 | 31 | 0.002 | — | |
| EX 8 | SPC | Consistent interference color | Ti + Zr | Zn + Ca | — | 0.05 | 87 | 0.04 | — | |
| EX 9 | GA | Consistent grayish black color | Ti + Hf | Mg + Ca | — | 0.18 | 114 | 0.11 | — | |
| EX 10 | SPC | Consistent interference color | Zr | Zn + Mg | — | 0.37 | 154 | 0.15 | — | |
| EX 11 | GA | Consistent grayish black color | Zr + Hf | Ca | naphthalene sulfonic acid | 0.006 | 55 | 0.007 | 0.01 | |
| EX 12 | SPC | Consistent interference color | Zr | Mg | chitosan + polyallyl-amine | 0.08 | 95 | 0.02 | 0.08 | |
| EX 13 | GA | Consistent grayish yellow color | Zr | — | — | 0.01 | 9 | — | — | |
| CE 1 | GA | Consistent interference color | Cr | — | — | — | Cr:30 | — | — | |
| CE 2 | SPC | Consistent interference color | Ti | — | — | 0 | 22 | — | — | |
| CE 3 | SPC | Consistent interference color | Zr + Hf | — | — | 3.2 | 45 | — | — | |

*Fluorine content in the coating: 11.7% by weight

TABLE 2

Results of corrosion resistance and adhesion tests

| | Test plate | Electro-deposited plate SST test (score) | 3 coat plate 1st ADH (Number of peeled squares) | 3 coat plate 2nd ADH (Number of peeled squares) |
|---|---|---|---|---|
| Example 1 | GA | A | 0 | 0 |
| Example 2 | SPC | A | 0 | 0 |
| Example 3 | GA | A | 0 | 0 |
| Example 4 | SPC | A | 0 | 0 |
| Example 5 | GA | A | 0 | 0 |
| Example 6 | SPC | A | 0 | 0 |
| Example 7 | GA | A | 0 | 0 |
| Example 8 | SPC | A | 0 | 0 |
| Example 9 | GA | A | 0 | 0 |
| Example 10 | SPC | A | 0 | 0 |
| Example 11 | GA | A | 0 | 0 |
| Example 12 | SPC | A | 0 | 0 |
| Example 13 | GA | C | 0 | 3 |
| Comparative Example 1 | GA | D | 0 | 15 |
| Comparative Example 2 | SPC | B | 0 | 27 |
| Comparative Example 3 | SPC | D | 0 | 7 |

The invention claimed is:

1. A surface-treated metal material having a coating layer formed on a surface of a metal material by a surface treatment, the coating layer comprising a component (A), which is an oxide and/or hydroxide of at least one metal selected from the group consisting of Ti, Zr and Hf, and a component (B), which is aluminum, wherein in the coating layer formed by the surface treatment, a weight ratio $K_1$=(B/A), where B is the coating weight of aluminum of component (B) to the coating weight A of the metal of component (A), is in a range of $0.001 \leqq K_1 \leqq 2$ and the sum of the coating weight A and the coating weight B is in a range of 20 to 1000 mg/m$^2$.

2. The surface treated metal material according to claim 1, wherein the aluminum constituting the component (B) is derived from an inorganic material.

3. The surface treated metal material according to claim 1, wherein the coating layer further comprises a component (C), which is at least one metal selected from the group consisting of Zn, Ca and Mg, and in the coating layer formed by the surface treatment, a weight ratio $K_2$=(C/A), where C is the coating weight of the metal of the component (C), is in a range of $0 < K_2 \leqq 1$.

4. The surface treated metal material according to claim 1, wherein the coating layer further comprises a component (D), which is at least one polymeric compound, and in the coating layer formed by the surface treatment, a weight ratio $K_3$=(D/A), where D is the coating weight of the polymeric compound of component (D), is in the range of $0<K_3 \leqq 1$.

5. The surface treated metal material according to claim 1, wherein the coating layer is formed by a surface treatment method which comprises bringing the surface of the metal material into contact with an aqueous solution that contains (a) at least one metal selected from the group consisting of Ti, Zr and Hf, (b) aluminum and (e) fluorine, and has a concentration of the metal (a) of 5 to 5000 ppm, a molar concentration ratio of fluorine (e) to the metal (a) of at least 6, and a molar concentration ratio of aluminum (b) to fluorine (e) of 0.05 to 1.0.

* * * * *